US008286943B2

(12) United States Patent
Noles, Jr. et al.

(10) Patent No.: US 8,286,943 B2
(45) Date of Patent: Oct. 16, 2012

(54) PUSHING OR PULLING DEVICE

(75) Inventors: Jerry W. Noles, Jr., Newcastle, OK (US); Dudley J. Perio, Jr., Austin, TX (US)

(73) Assignee: Express Energy Services Operating LP, Houston, TX (US)

( * ) Notice: Subject to any disclaimer, the term of this patent is extended or adjusted under 35 U.S.C. 154(b) by 384 days.

(21) Appl. No.: 12/780,459

(22) Filed: May 14, 2010

(65) Prior Publication Data

US 2011/0278514 A1 Nov. 17, 2011

(51) Int. Cl.
*E21B 19/00* (2006.01)
*B65H 23/08* (2006.01)

(52) U.S. Cl. ..... 254/30; 226/108; 226/177; 226/194; 254/134

(58) Field of Classification Search ..... 254/100, 254/103, 133 R, 134, 30, 131, 131.5; 414/746.8; 166/380, 77.1, 77.2, 77.3, 77.4, 77.51, 77.52, 166/77.53; 226/4, 108, 177, 181, 188, 194
See application file for complete search history.

(56) References Cited

U.S. PATENT DOCUMENTS

| | | | | |
|---|---|---|---|---|
| 2,262,364 | A * | 11/1941 | Hugel et al. | 166/77.1 |
| 3,473,715 | A * | 10/1969 | Shuey, Jr. | 226/108 |
| 3,658,222 | A * | 4/1972 | Dressel et al. | 226/25 |
| 3,797,570 | A | 3/1974 | Leutwyler | |
| 3,871,618 | A * | 3/1975 | Funk | 254/30 |
| 4,119,297 | A | 10/1978 | Gunther | |
| 4,515,211 | A | 5/1985 | Reed et al. | |
| 5,419,480 | A * | 5/1995 | Pratt | 226/108 |
| 5,934,537 | A | 8/1999 | Miller | |
| 6,460,634 | B1 * | 10/2002 | Hart et al. | 175/85 |
| 6,530,719 | B1 * | 3/2003 | Stephan | 403/364 |
| 6,968,894 | B2 * | 11/2005 | Austbo et al. | 166/77.3 |
| 7,028,787 | B2 * | 4/2006 | Allen et al. | 175/162 |
| 2009/0056931 | A1 * | 3/2009 | Kruse et al. | 166/77.51 |
| 2009/0272520 | A1 * | 11/2009 | Hug et al. | 166/77.2 |
| 2010/0193179 | A1 * | 8/2010 | Tucken | 166/77.1 |

* cited by examiner

*Primary Examiner* — Brian Glessner
*Assistant Examiner* — Joseph J Sadlon
(74) *Attorney, Agent, or Firm* — John J. Love; Claude E. Cooke, Jr.; Cooke Law Firm

(57) ABSTRACT

A handling assembly includes motor driver wheel assemblies that are supported on one or more platforms. The wheel assembles can be moved inwardly into engagement with tubing, cable or rods extending through the platforms so that the tubing, cable or rods can be raised or lowered in a controlled manner by frictional contact between the driven wheels and the tubing, cable or rods.

12 Claims, 5 Drawing Sheets

PUSHING OR PULLING DEVICE

BACKGROUND OF INVENTION

1. Field of the Invention

This invention is directed to a device for raising or lowering tubing, cable, rods or tubular structure for example, but not limited to, within a well. Such devices are commonly called snubbing assemblies or snubbers when used in conjunction with a well. This invention may be used in any industry or application where there is a need to raise and lower a tubing, cable, or rod in a controlled manner.

2. Description of Related Art

The purpose of a snubbing unit is to run tubing or pipe into and out of the well bore with the well bore having a greater pressure than the normal atmospheric pressure. In most cases during drilling or completion of an oil and gas well, if the well pressure exceeds the weight of the tubing or pipe the tubing could be ejected from the well. This pipe ejection is referred to as a blow out. In Order to prevent this ejection the oil and gas industry uses two methods for controlling the well. One method is to use a weighting to control it and the other is to complete the well using live well procedures i.e. snubbing. Recently the oil and gas industry has begun to better understand that the use of drilling mud/weighting materials with a high enough weight to balance the well's natural pressure can cause damage to the formation thus inhibiting the productivity of the well. Therefore the practice of insertion of the tubing into and out of the well bore under pressure (snubbing) has increased.

The current method used for this under balanced insertion of the tubing, referred to as snubbing, is a process that uses cables, chains or hydraulic cylinders and two sets of inverted slips to push the tubing into and out of the well bore under pressure. This is done in a hand over hand process where one set of the slips are closed around the tubing and then pulled against the opposing force of the well. This load or well bore force is then transferred through the pipe and then to the slips. The pipe is held stationary by one set of slips that are tied to the well while the other set of slips travel up and down the pipe. The traveling slips grab the tubing or pipe and the slips are then draw downward. Once the load of the tubing or pipe is transferred to these slips, the stationary slips are opened and the pipe is pushed into the wellbore through either a stripping rubber or a set of blow out preventer (BOP) rams, both of which are designed to seal around the outside of the pipe or tubing keeping the well bore pressure contained. Once the traveling set of slips has reached its lowest travel point, the bottom or stationary set of slips are closed and the traveling set of slips are opened and raised to take another bite. The process is then repeated until the length of the pipe can be fully inserted into the well. This process is very slow and requires a well organized movement between the two sets of slips.

These snubbing operations can be broken into two categories. The first one is referred to as a stand-alone snubbing unit. This unit is completely self contained and needs no assistance to handle the tubing in and out of the well bore. It has two sets of stationary slips and two sets of traveling slips. One set of these slips is to hold and transfer the load of the tubing when the pipe is being snubbed and the other set holds the pipe when it is in heavy position. This allows the snubbing unit to handle the pipe in both positive and negative load positions.

The other type of snubbing unit is referred to as a rig assist unit. In this case the snubbing unit is used to assist a work-over in running of the pipe. Once the snubbing unit has pushed the tubing into the well and the weight of the pipe is enough to overcome the pressure from the well the work-over rig takes over and finishes running the tubing into the well bore. The reason for this is the work-over rig can run the tubing into the well bore much faster than a snubbing unit that has to use the hand over hand operations. Because the snubbing unit is not equipped with slips to handle the pipe in the heavy position, the work over has to be used to assist this unit in running the pipe. This motion requires great coordination between the snubbing operator and the work over rig operator. Any mistake can result in a blow out or the accidental release of the tubing from the wellbore.

Both of these types of units are very slow and require great coordination to run the pipe with any speed. This complexity of operation provides a need for equipment and operations that are much less complex and safer that the current operations. The current invention does just that.

BRIEF SUMMARY OF THE INVENTION

The current invention uses hydraulically powered wheels to push the tubing into and out of the wellbore instead of cylinders, cables or chains. This invention allows the pipe to be handled in both a positive and a negative position. This means one unit can be used as both a standalone and a rig assist unit. By using these powered wheels the unit is seamless in its pipe movement for both the positive and the negative pipe running. During snubbing operations this invention uses positive downward force to allow the rig operator to run the tubing in a conventional rig tubing running procedure just like they would if they were running into the well with no pressure on the well. This eliminates the need for the rig and the snubbing operator to stay in tune with one another making the unit much safer. This invention has a smaller equipment footprint than units currently used in the rig assist/standalone snubbing market. This reduced height allows longer joints of pipe to be run within the dimensional clearance between the top of the BOPs and the crown section of the work over rig. This unit is also designed so additional sections can be added to increase the snubbing or lifting capability without having to modify the entire system.

In one embodiment the pipe is held secure by four contact or drive wheels that are set on a 90 degree phase from one another. This allows the drive wheels to operate opposing each other so the pipe is specially secured and centered with forty-five degree contact points on four sides with each layer being set at 45 deg from the top or bottom layer. The cylinders that are located at the rear of the drive wheels push the drive wheels into engagement with the pipe allowing the drive wheels to stay in contact with the pipe and eliminate slippage during pipe movement. This force is referred to as "force normal" and is the force required to eliminate pipe slippage. This "force normal" pressure is increased as the load is increased whether it is positive or negative. This cylinder placement also allows the drive wheels to find the natural center alignment for the pipe as well as open and close without losing contact with the pipe as changes in pipe diameter are contacted. The device can handle pipe sizes from 2⅜" O.D. to 5½" O.D. without having to change the drive wheels. This allows rapid changes in pipe diameter and wide range of load applications. This configuration also allows for a wide range of different materials to be used on the drive wheels that may be more compatible with the tubing or pipe that is being run into the wellbore. Rubber coated drive wheels could be used for pipe that is easily damaged from the slip marks of conventional equipment.

BRIEF DESCRIPTION OF THE SEVERAL VIEWS OF THE DRAWING(S)

Figure 3:
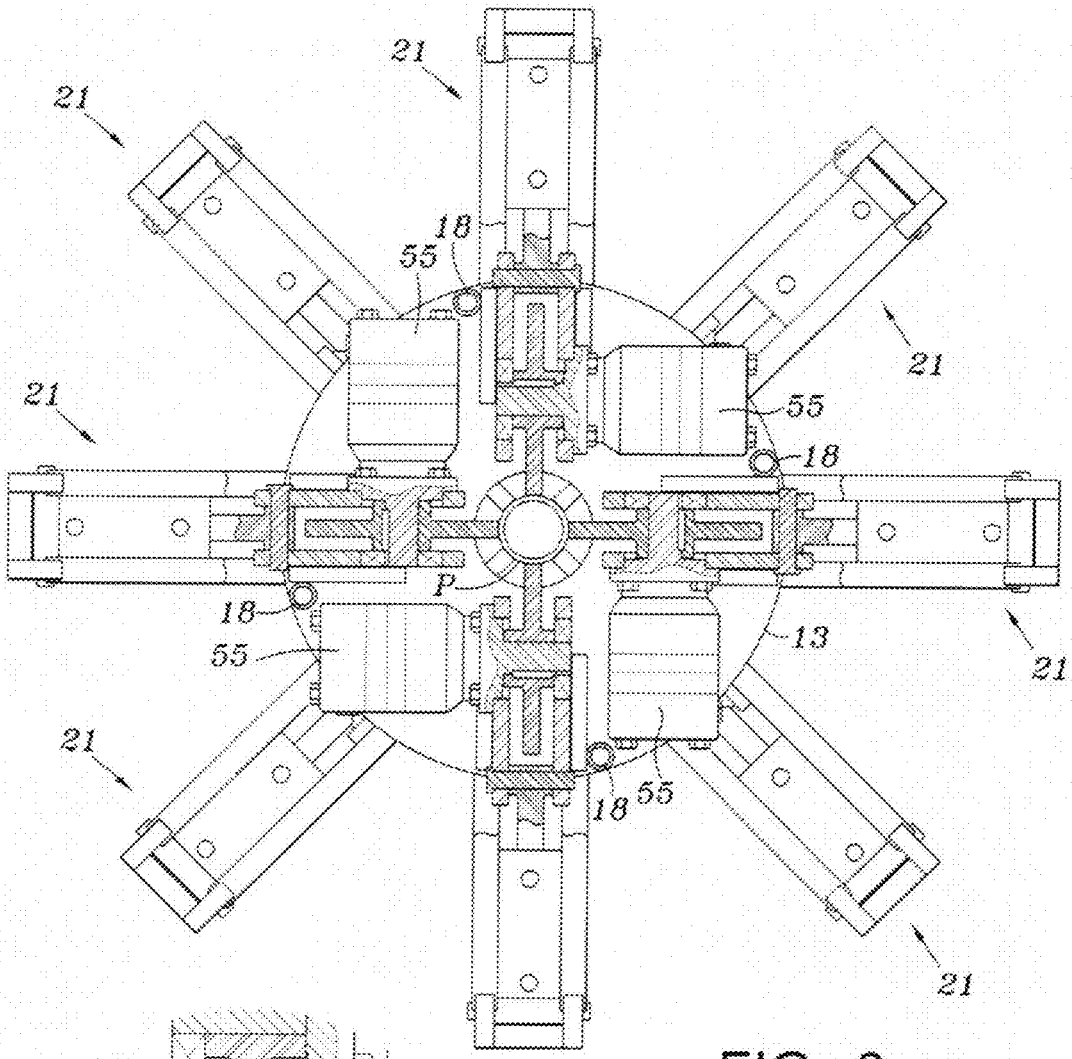
FIG. 3 is a view taken along line 3-3 of FIG. 2.
Figure 3A:
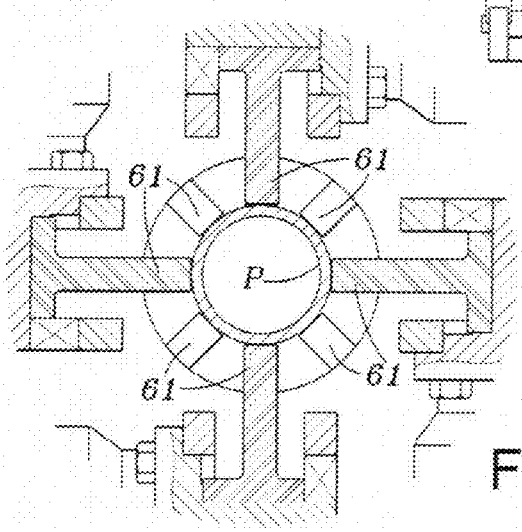

FIG. 3*a* is a view of the wheels engaging the tubing, cable or rods.

Figure 4:
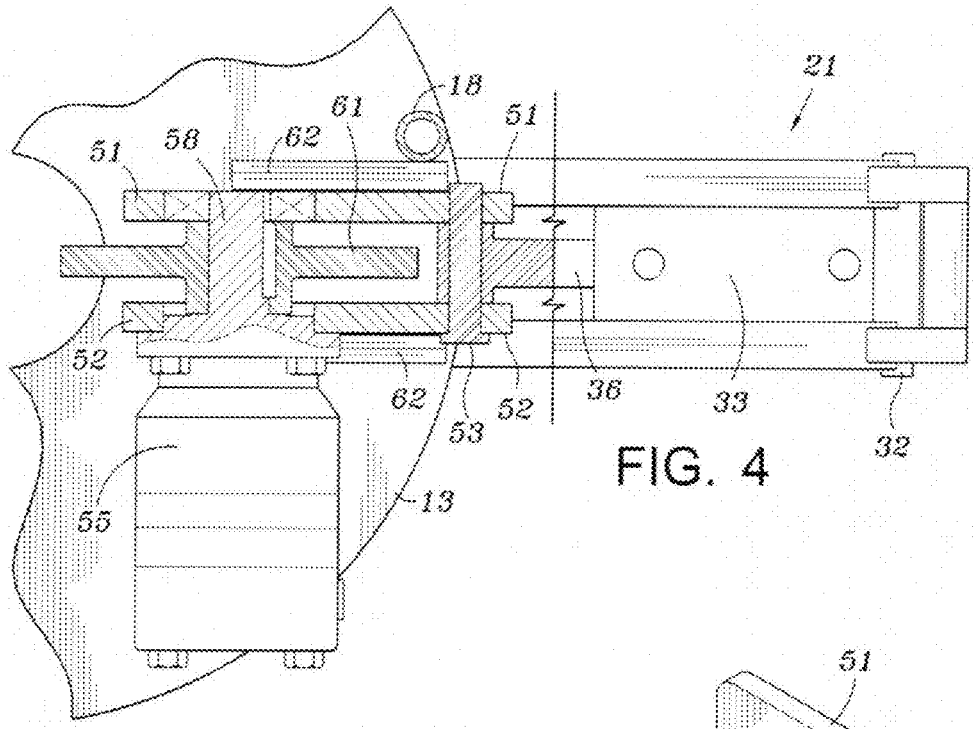

FIG. 4 is a view of the drive wheel assembly.

Figure 5:
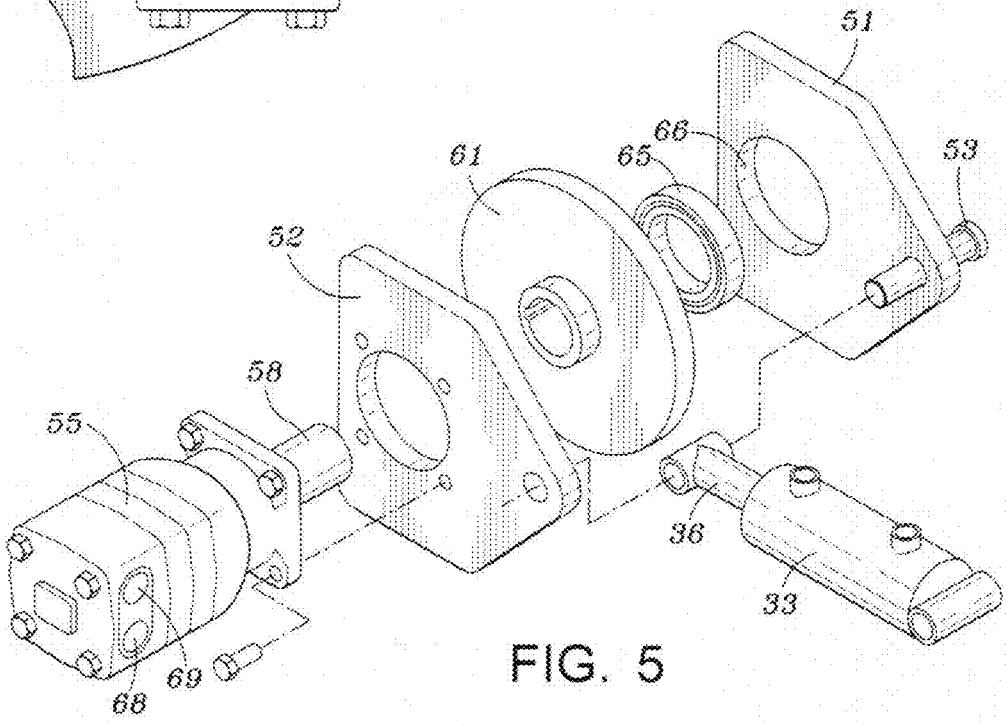

FIG. 5 is an exploded view of the drive wheel assembly.

Figure 6:
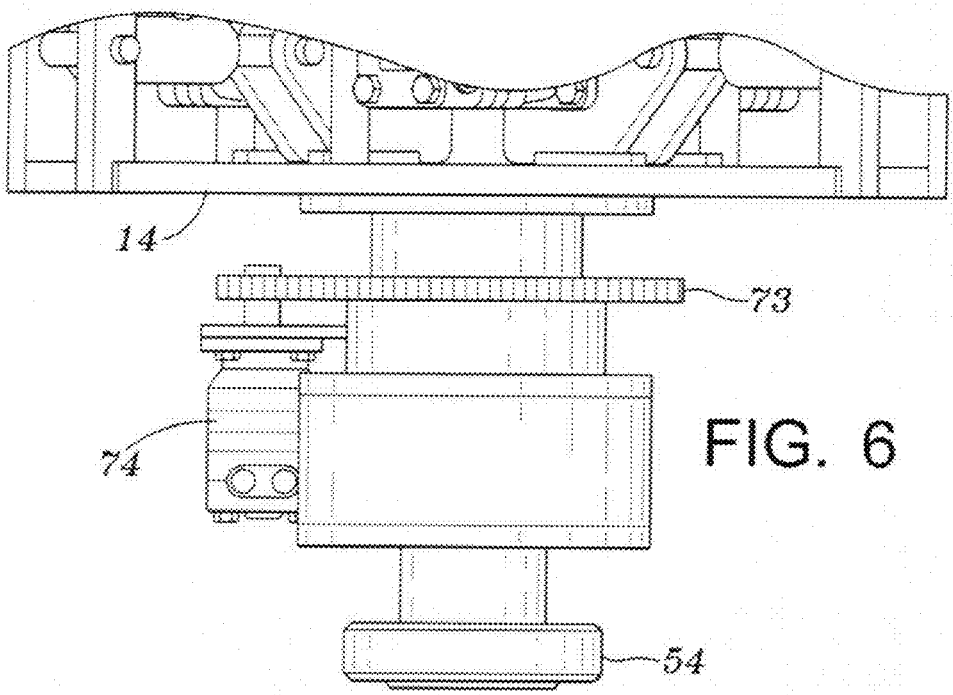

FIG. 6 is a front view of the rotary coupling for the device.

Figure 7:
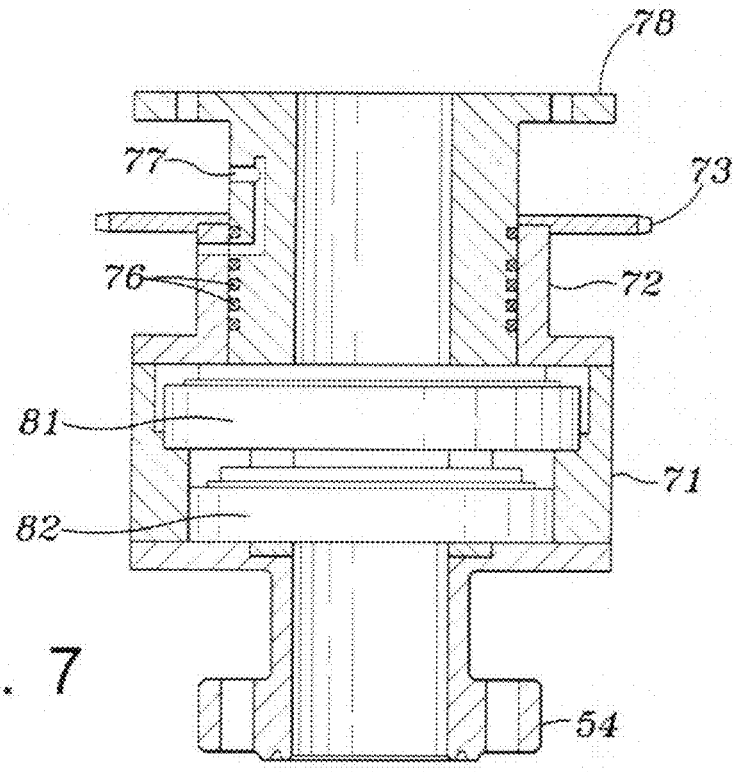

FIG. 7 is a sectional view of the rotary coupling.

Figure 1:
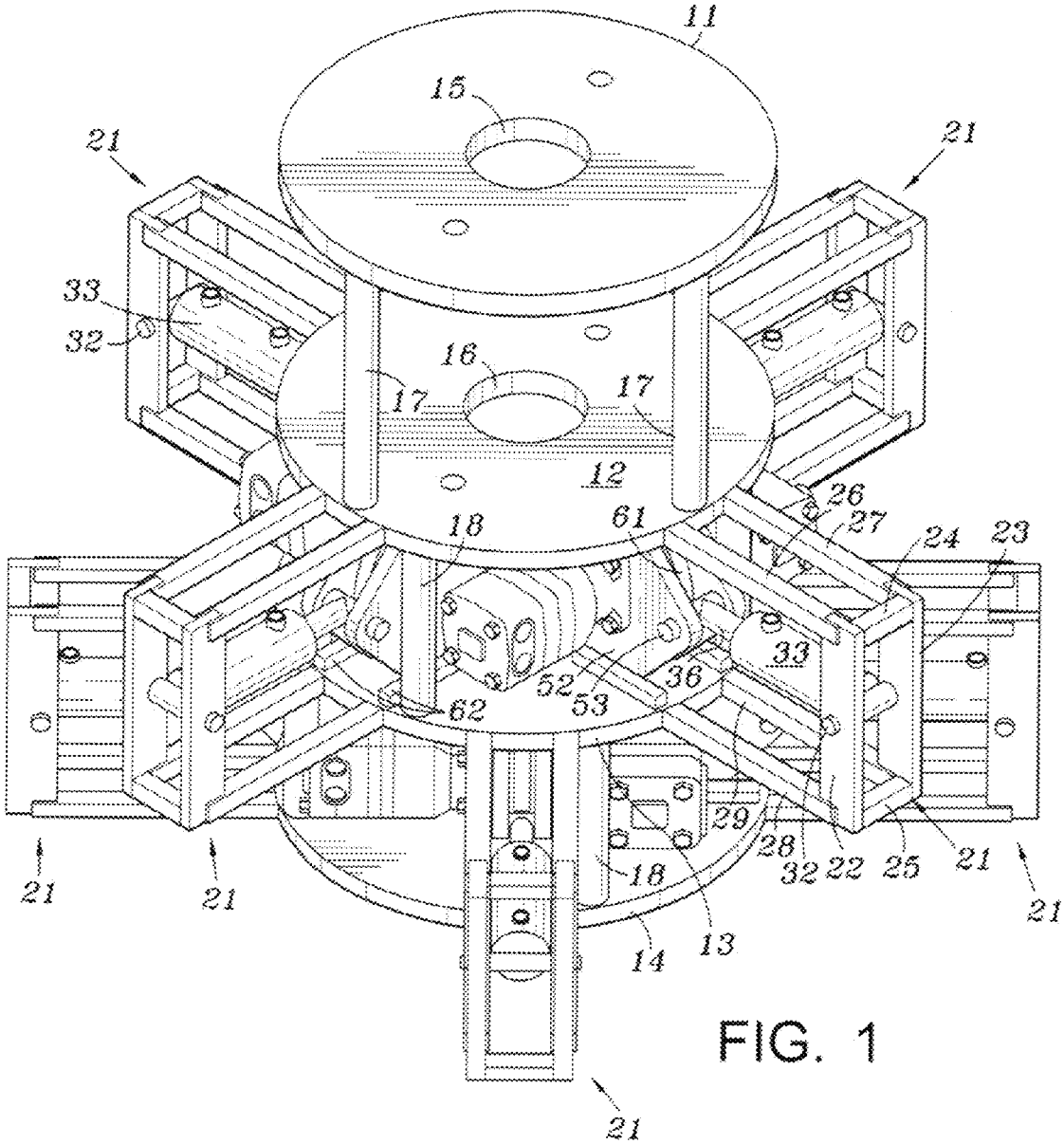
FIG. 1 is a perspective view of the apparatus according to an embodiment of the invention.
Figure 2:
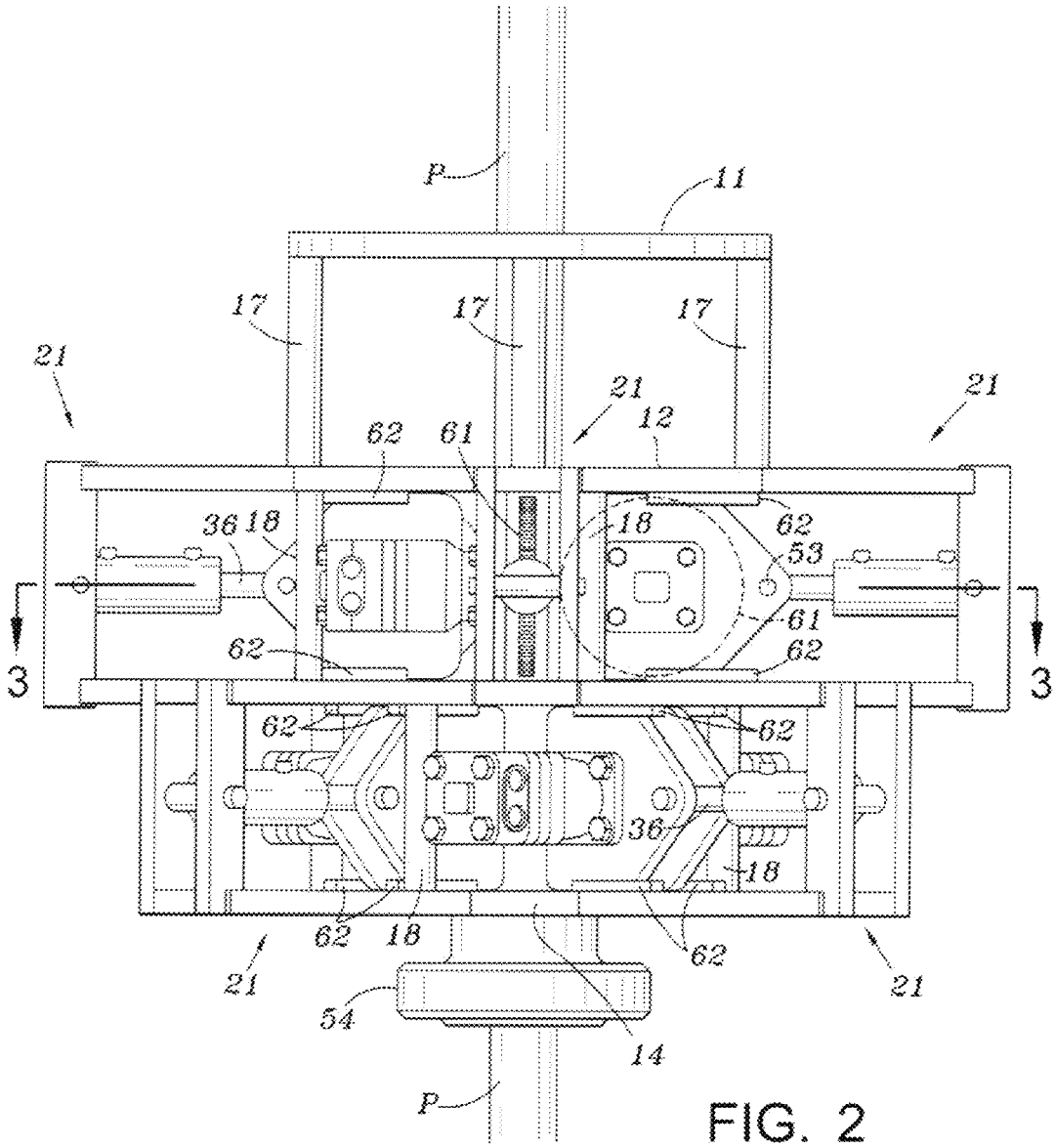
FIG. 2 is a front view of the apparatus shown in FIG. 1.

Referring to FIG. 1, an embodiment of the invention includes a top circular platform 11 having an opening 15 therein through which tubulars, cables or rods can pass. Top platform 11 is rigidly connected to a second platform member 12 via supports 17. A third platform member 13 is connected to second platform member 12 by suitable vertical supports 18. Bottom platform member 14 is rigidly connected to third platform member 12 by similar vertical supports 18. A coupler 54 for the well head is secured to platform 14. Four actuator assemblies 21 are located between platform 12 and platform 13 at 90° intervals. Four additional actuator assemblies may be located between platform members 13 and 14 also at 90° apart and offset 45° from the actuator assemblies 21 located above. It is understood that more or less than four assemblies may be provided between the platforms and that the spacing between the assemblies on the platforms may vary as desired. Additional assemblies 21 may be positioned between platforms 11 and 12.

Each actuator assembly includes a frame which includes two vertical supports 22, 23, upper horizontal supports 26 and 27 that are fixed to platform 12, lower horizontal supports 28 and 29 that are fixed to platform 13 and upper and lower supports 24 and 25 that extend between supports 22 and 23. Lower actuating assemblies 21 are connected to platforms 13 and 14 in a similar fashion. Support members 22 and 23 receive a pin 32 which secures one end of piston cylinder actuator 33 to the frame as shown in FIGS. 1 and 4. The piston portion 36 of the actuator is connected via a pivot pin 53 to two vertical support plates 51 and 52 as shown in FIG. 5. Reversible hydraulic motors 55 are connected to plates 52 and include a drive shaft shown generally at 58. Wheels 61 are mounted on drive shafts 58. As shown in FIG. 1, vertical plates 51 and 52 slide within a channel formed by horizontal struts 62 which are fixed to platforms 13 and 14. Cylinder piston actuators 33 and hydraulic motors 55 are provided with pressure fluid inlets and outlets as in known in the art.

As shown in FIGS. 4 and 5, reversible hydraulic motors 55 are secured between plate members 52 and 51. A plurality of bolts mount motor 55 to plate 52. Plate 51 is provided with an aperture 66 in which bearing 65 is located. Drive shaft 58 of hydraulic motor 55 supports wheel 61. Bearing 65 rotatably supports shaft 58. The hydraulic actuators have a piston portion 36 that is connected to plates 51 and 52 via pin 53. The cylinder portion 33 is connected to the support frame via pin 32 shown in FIG. 4. FIGS. 6 and 7 illustrate an embodiment of the invention that includes a rotary coupling assembly for rotatably coupling the snubber assembly to a well head. The assembly includes lower connector 54 that is adapted to be secured to the well head. Bearing housings 71 and 72 support suitable bearings 81 and 82, for example spherical roller thrust bearings, which rotatably support upper connector 78 which is rigidly connected to platform 14. Upper connector 78 is provided with oil passageway 77 and seals 76. A sprocket 73 is secured upper connector 78 and is driven by a hydraulic motor 74 via a chain.

In operation when it is desired to lower or raise tubulars within the well, power cylinders 33 can be actuated to move the hydraulic motors supported by plates 51 and 52 toward the tubular. Thus will bring wheels 61 into engagement with the tubulars and the motors can then be driven in either direction to lower or raise the tubular, in a controlled manner. Four or eight drive units or more can be utilized depending on the amount of force required to raise or lower the tubulars. The number and the spacing of the wheel assemblies may be varied on the platforms as desired. The outside contact surface of wheels 61 may be knurled and hardened. They may alternatively be coated with a plastic or rubberized coating depending on the type of tubulars that are being raised or lowered. The wheels 61 may be solid wheels or multiple assemblies with a replaceable insert sleeve or multiple segments that bolt or attach to the inner wheel to provide different shapes and materials to confirm to the item push or pulled through the device.

Although the present invention has been described with respect to specific details, it is not intended that such details should be regarded as limitations on the scope of the invention, except to the extent that they are included in the accompanying claims.

We claim:

1. An apparatus for raising or lowering tubing, cable or rods in a controlled manner comprising:

a first platform having an aperture centrally located therein for receiving tubing, cable or rods;

a second platform having an aperture centrally located therein for receiving tubing, cable or rods;

a plurality of wheel assemblies supported between the platforms;

each wheel assembly including a motor, a wheel driven by the motor and an actuator for moving the motor and wheel radially inwardly toward the apertures so that the wheel may be brought into contact with tubing, cable or rods extending through the apertures.

2. The apparatus according to claim 1 wherein four wheel assemblies are positioned around the platforms at 90° intervals.

3. The apparatus of claim 2 comprising a third platform with an aperture therein to receive tubing, cable or rods, and a plurality of wheel assemblies supported between the second and third platforms.

4. The apparatus according to claim 3 comprising four wheel assemblies supported between the second and third platforms spaced 90° around the platform and positioned 45° apart with respect to the wheel assemblies positioned between the first and second platforms.

5. The apparatus of claim 4 wherein the first, second, and third platform are circular in shape.

6. The apparatus of claim 1 further including a coupler secured to one of the platforms for coupling the assembly to a well head.

7. The apparatus of claim 6 wherein the coupler includes a bearing assembly for rotatably securing the apparatus to a wellhead.

8. The apparatus of claim 1 wherein the outer surface of the wheels that contacts the tubing, cable or rods is knurled and heat treated.

9. The apparatus of claim 1 wherein the outer surface of the wheels that contacts the tubing, cable or rods is provided with a rubberized or plastic coating.

10. The apparatus of claim 1 wherein each wheel assembly comprises a pair of parallel plates, a motor mounted to one of the plates having a drive shaft extending to a bearing provided in the second plate and a wheel mounted on the shaft between the plates.

11. The apparatus of claim 10 wherein the wheel assembly further comprises a hydraulic cylinder actuator having a cylinder secured to one of the platforms and a actuator coupled to the plates.

12. A handling apparatus comprising:

a support member having an opening therein for receiving tubing, cable or rods;

a plurality of wheel assemblies supported on the support member; and each wheel assembly including a motor, a wheel driven by the motor and an actuator for moving the wheel assembly inwardly toward the opening so that the wheel may be brought into contact with tubing, cable or rods extending through the opening.

* * * * *